US006038120A

United States Patent [19]

May et al.

[11] Patent Number: 6,038,120

[45] Date of Patent: Mar. 14, 2000

[54] AC CORONA CHARGER WITH BURIED FLOOR ELECTRODE

[75] Inventors: John W. May, Rochester; Martin J. Pernesky, Hornell; George R. Walgrove, Rochester, all of N.Y.

[73] Assignee: Eastman Kodak Company, Rochester, N.Y.

[21] Appl. No.: 09/164,064

[22] Filed: Sep. 30, 1998

[51] Int. Cl.[7] ..... H01T 19/04

[52] U.S. Cl. ..... 361/227; 361/229; 250/324

[58] Field of Search ..... 361/225–229, 361/212, 230, 213; 250/324–326; 96/95, 98, 99; 399/170–172

[56] References Cited

U.S. PATENT DOCUMENTS

| | | | |
|---|---|---|---|
| 3,742,237 | 6/1973 | Parker | 250/324 |
| 3,978,379 | 8/1976 | DelVecchio . | |
| 4,053,769 | 10/1977 | Nishikawa et al. . | |
| 4,754,305 | 6/1988 | Fantuzzo et al. . | |
| 4,775,915 | 10/1988 | Walgrove, III . | |
| 5,018,045 | 5/1991 | Myochin et al. . | |
| 5,126,794 | 6/1992 | Altmann | 399/170 |
| 5,377,070 | 12/1994 | Kawamoto | 361/229 |
| 5,451,754 | 9/1995 | Reale | 250/324 |
| 5,469,242 | 11/1995 | Yu et al. | 399/172 |
| 5,568,230 | 10/1996 | Reddy et al. . | |
| 5,642,254 | 6/1997 | Benwood et al. . | |

OTHER PUBLICATIONS

R.M. Schaffert, M.A., Ph.D., Electrophotography, p. 234.

*Primary Examiner*—Jeffrey Gaffin
*Assistant Examiner*—Kim Huynh
*Attorney, Agent, or Firm*—Norman Rushefsky

[57] ABSTRACT

A corona charger and method and apparatus for corona charging features an insulative shield and an electrically biased grid electrode spaced from the shield. One or more substantially bare corona wires are located between the grid electrode and the shield. The corona wires are electrically biased with an AC voltage. An electrically biased highly conductive buried floor electrode forms a part of the charger and has a surface located between the one or more corona wires and the shield. An insulating layer is located between the corona wires and the surface of the buried floor electrode so that there is no exposure of the buried floor electrode in a direct line of sight from a corona wire.

25 Claims, 7 Drawing Sheets

HEIGHT OF GROUNDED ELECTRODE ABOVE FLOOR OR TOTAL PMMA THICKNESS USING FLOATING ELECTRODE OR NO ELECTRODE (1/16 INCH)

AC CORONA CHARGER WITH BURIED FLOOR ELECTRODE

FIELD OF THE INVENTION

The invention relates to corona chargers particularly for use in electrophotography, and further to an AC primary charger comprising an improved shield member.

BACKGROUND OF THE INVENTION

It has been known for many years that the use of one or more grounded electrodes near one or more corona wires in a gridded corona wire charger enhances DC corona emission current and also DC charging current (see, for example, R. M. Schaffert, *Electrophotography*, Focal Press, Revised and Enlarged Edition, 1975, p.234 (FIG. 92)). Until recently, however, little information has been published concerning the effects of grounded electrodes on the uniformity of corona charging current along the length of a corona wire, especially for AC charging using a control grid (AC scorotron).

As an AC charger ages during usage in a machine, conductive contamination compounds (corona chemistry by-products) can become deposited and build up on the surfaces of interior walls of a charger shield. The shield, inclusive of the endwalls, typically comprises an insulating plastic, such as used in primary chargers for Eastman Kodak's Ektaprint 2100, Ektaprint 3100, and Ektaprint IS110 electrophotographic machines. If a standard AC charger of this type is modified to have a grounded conductive floor surface, a problem can arise when conductive contamination compounds become deposited on the surfaces of the insulating endwalls and also deposited on the surface of ceramic insulation of a high voltage connector passing through an endwall stanchion to a terminal to provide high voltage from a power supply to a corona wire connected to the terminal. As a result of a high electric field between the terminal and a bare, grounded, conductive floor electrode, flashover electrical breakdown can occur, the flashover discharge passing between terminal and electrode across a contaminated endwall surface and thence over a contaminated surface of a ceramic insulator stanchion. The electrical breakdown over the surface of the insulation can produce an arc that can cause hard shutdown of an electrophotographic machine.

In DelVecchio, U.S. Pat. No. 3,978,379, it is stated in col. 2, lines 47–54, that "one way of increasing the plate current (i.e., charging current) and decreasing the shield current is to construct the shield so that the interior thereof opposite the photoreceptor has a dielectric surface that will increase the plate current component and decrease the shield current component by directing some of the upwardly directed (i.e., towards the shield) corona emissions downwardly toward the photoreceptor." The charger is presumably a DC charger. There is no disclosure in DelVecchio relating to charging current uniformity.

Nishikawa et. al., U.S. Pat. No. 4,053,769, describe a DC corona wire charger wherein a shield electrode is provided at its inner walls with an insulated layer. Nishikawa et al. notes that the insulating layer has a leak resistance which is inherent to the general property of the insulating material per se. This leak resistance is rapidly decreased to a small value as the voltage applied to the corona charge wire from the high voltage source is increased. As a result, if the flow of ions from the corona discharge wire arrives at the surface of the insulating layer, a constant surface electric potential is applied to the surface of the insulating layer, the constant surface potential being determined by the thickness and material of the insulating layer. This surface electric potential is stabilized at a value at which the leak resistance inherent to the property of the insulating material and the corona current are balanced with each other. The above description of Nishikawa et al. is thus consistent with a DC corona wire charger.

Fantuzzo, U.S. Pat. No. 4,754,305, discloses an AC charger using a corona wire coated with an electrically insulating layer, an electrically conducting U-shaped shield, and no grid.

Walgrove, U.S. Pat. No. 4,775,915, describes an AC corona wire charger comprising a non-conductive shell having no grid and further comprising an electrode inside the shell, the corona wire situated between electrode and a receiver. No dielectric coating on the electrode is disclosed.

Myochin et. al., U.S. Pat. No. 5,018,045, disclose a DC charger comprising a grounded conductive backplate physically separated from two DC-biased conductive sidewalls, all of which are physically separated from a DC-biased control grid which is parallel to the backplate, such that backplate, sidewalls and grid enclose a DC corona wire. FIG. 6 shows, as a comparative example, a similar prior art structure comprising grounded sidewalls such that the sidewalls and backplate are coated with electrically insulating Mylar® (polyethyleneterephthalate) plates.

In Benwood et. al., U.S. Pat. No. 5,642,254, some data are given for a 3-wire gridded AC charger comprising either a plastic floor, such as found for example in an Eastman Kodak Ektaprint 2100 electrophotographic machine, or a plastic floor covered by a bare metal grounded floor electrode. Different configurations are used in different examples. For a standard squarewave AC waveform (50% duty cycle), peak AC voltage ±8 KV, zero DC offset, and grid-to-collector spacing 0.060 inch, comparison of Tables 4 and 7 shows a 23% increase of the charging current using a grounded bare metal floor electrode instead of a standard plastic floor, as measured by a probe scanned along the length of the charger (parallel to the corona wires). On the other hand, a plastic floor used with extended plastic sideshields produced increases of charging current of 49% and 53%, using two different sets of corona wires (Tables 1, 3 and 4). Making both the floor and sidewalls conductive (without using extended sideshields) was also very beneficial, giving a 15% increase with peak AC voltage reduced by 1000 volts (to ±7 KV). The charging current uniformity, in a direction parallel to the corona wires, was apparently somewhat improved by the presence of the bare metal floor electrode, but the results are not conclusive on account of the use of different sets of corona wires in different examples.

Reddy and Litman, U.S. Pat. No. 5,568,230, describe a non-gridded AC charger comprising a dielectric-coated corona wire and a conductive shell further comprising an ozone neutralizing element in the form of a liner of the shell. The conductive shell may be grounded so that the charger acts as a neutralizer, or it may be biased with a DC potential so as to provide charging of the same polarity as the DC potential. The liner material described in this patent comprises an ozone-neutralizing layer, a support layer, and an adhesive layer. There is no disclosure regarding the electrical conductivities of these layers. There is some disclosure regarding the thickness as preferably in the form of a substantially thin coating at least 5 $\mu$m thick.

It is well known that uniformity of charging is closely related to the uniformity of corona current emitted along the length of the corona wires. Corona current emitted from a wire typically shows significant fluctuations from one site to another on the wire. One can measure the resulting nonuniformity of the charging current along the length of a set of parallel corona wires in a gridded charger by means of a scanning probe, consisting of a thin grounded collector electrode inserted in a narrow slit cut in a large grounded plate electrode (slit perpendicular to wires). This is appropriately done by setting the collector-to-grid spacing at the same value as used for charging a photoconductor. It can be shown from a theoretical analysis that a deviation of output voltage on a charged photoconductor, measured in a direction perpendicular to the process direction as the photoconductor exits a charging station, is approximately proportional to the standard deviation of the scanned current divided by the mean scanned current. Hence, the use of a scanning probe to measure the fluctuations of charging current transmitted by the grid is a very useful predictor of the output uniformity performance of a gridded charger.

There is a general need to improve image quality in toned electrophotographic prints by reducing mottle and granularity related to primary charging nonuniformities, especially in solid areas having low to medium densities. This need is particularly acute for high quality color electrophotography. As is well known, prior art negative AC primary chargers produce much more uniform voltages on photoconductors than negative DC chargers. A primary negative AC charger of the invention provides inexpensive means for further improvements in negative AC charging current uniformity, and as a result, it gives a correspondingly improved voltage uniformity on a photoconductor.

There is a further need to improve the efficiency of an AC charger, inasmuch as the impedance of an AC charger is usually considerably higher, typically by a factor of about two, than that of a DC charger. The present invention advantageously provides a reduced impedance and hence a correspondingly higher efficiency of primary charging of a photoconductor.

There is yet a further need to improve the rigidity of a prior art AC charger body, especially when comprising a plastic shield, because a high tensile force on corona wires can result in a plastic shield becoming slightly bowed after long use, thereby causing a slackening of wire tension and a large scale nonuniformity of the charging current owing to such slackness. All modes of the present invention can provide improved rigidity at low cost.

SUMMARY OF THE INVENTION

An AC negative corona bare wire charger in a preferred embodiment having a control grid is provided with a shield comprising a grounded or otherwise electrically biased floor electrode which is completely covered or buried by a smooth, substantially thick, highly insulating, layer. This cover layer, preferably made of a polymeric material, prevents surface electrical breakdown that can occur in the form of a flashover discharge between an uncovered grounded or otherwise electrically biased conductive floor electrode of a shield and an energized high voltage corona wire. Flashover discharge is very undesirable and causes considerable inconvenience to a customer. It will generally render a primary charger inoperative, and may even cause a hard shutdown. Such a flashover typically occurs as a result of conductive chemicals, produced by corona discharge, building up on interior surfaces of a charger shield after long usage in an electrophotographic machine. A flashover discharge travels between a bare, grounded, floor electrode and an energized corona wire by passing over the surface of a contaminated insulating bridge member that supports the corona wire. In the preferred mode, both the surface of the dielectric cover layer facing the corona wires and the surface of the underlying grounded or otherwise electrically biased floor electrode are considerably closer to the corona wires than the surface of an insulating floor in a prior art charger, and this unexpectedly results in a much more uniform charging current along the length of the corona wires, thereby producing improved image quality.

DETAILED DESCRIPTION OF THE INVENTION

Figure 1:
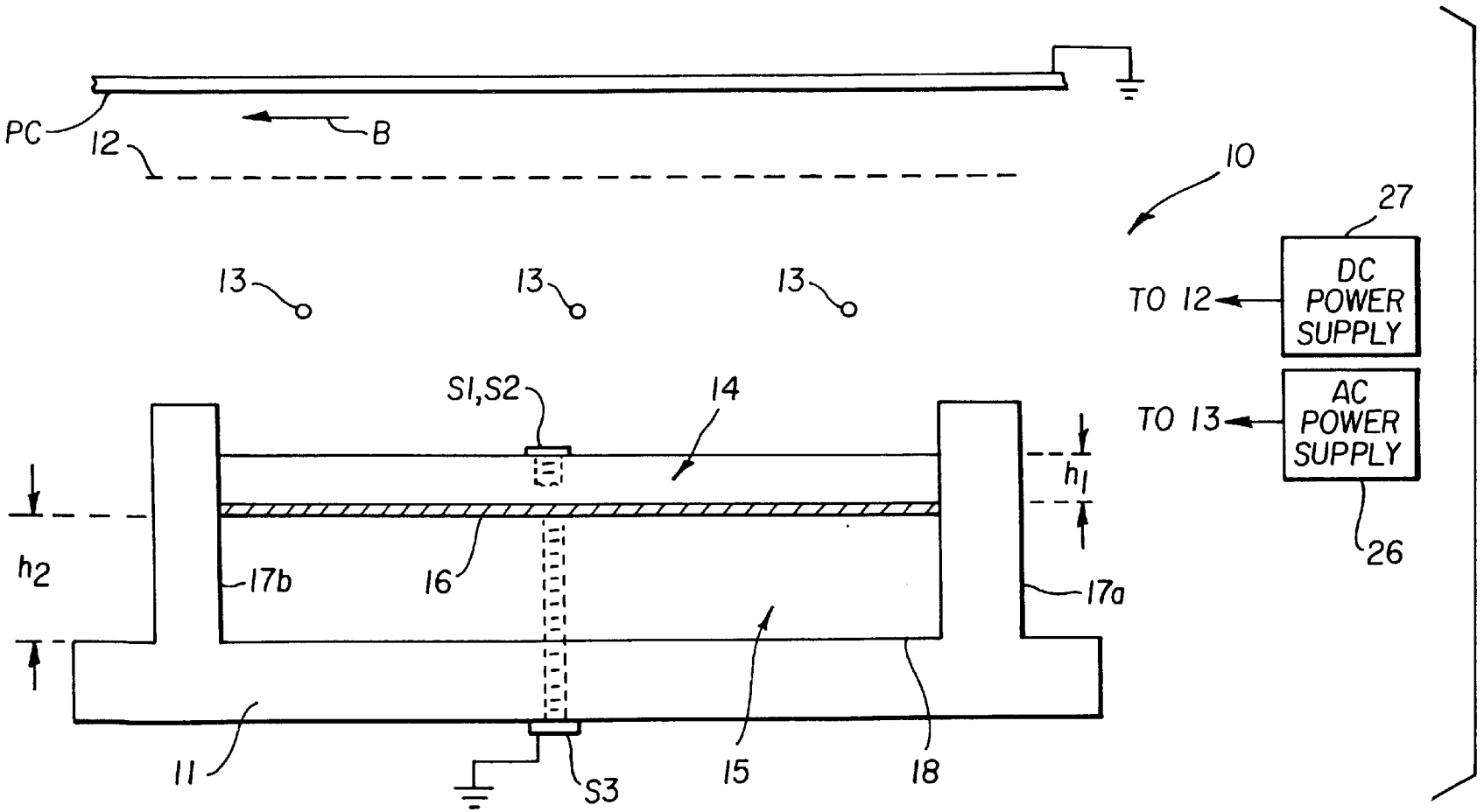
FIG. 1 is an end elevational view in schematic with certain details omitted for purposes of clarity and illustrating a first embodiment of a corona charging apparatus in accordance with the invention.

The invention provides an improvement of prior art AC negative corona wire primary chargers, such as used for example in Eastman Kodak's Ektaprint 2100, Ektaprint 3100, and Ektaprint IS110 electrophotographic machines. A primary charger in each of these machines comprises three corona wires powered by an AC trapezoidal voltage waveform having a DC offset, an approximately U-shaped insulating housing (or shield), and a planar tensioned DC-biased metal grid. The U-shaped insulating housing comprises a plastic member, typically having a flat base portion here called the floor of the charger, and two partial sidewalls at right angles to the floor. An Ektaprint IS110 primary charger has a longitudinal slot in the floor running effectively the length of the charger such that a motorized cleaning mechanism, comprising cleaning pads for cleaning the corona wires and the inner surface of the grid, can be moved along the useful charging length of the wires. The floor of an Ektaprint 2100 or Ektaprint 3100 primary charger does not have such a slot (an Ektaprint 3100 primary charger comprises a manual cleaner not requiring a slot).

In a first example of the invention, described in detail in FIG. 1 and later paragraphs, a commercial AC gridded charger 10 such as used in a Kodak Ektaprint 2100 copier machine is modified by providing an insert which is fitted into the insulating plastic shield. In experiments described below to illustrate the invention, an insert comprises parallel members situated between the corona wires and the original floor of the insulating shield, the members being: an outer sheet of a highly insulating plastic (such as for example polycarbonate, polymethylmethacrylate (PMMA), polytetrafluoroethylene (PTFE), or other suitable polymeric materials), a metal (or other similarly highly conductive) floor electrode completely covered by the outer sheet, and another layer of a highly insulating plastic resting on the original inner surface of the floor of the insulating housing. The outer sheet preferably comprises PTFE or other suitable unreactive polymeric material having a high resistance to chemical degradation by oxidizing species produced by coronas and may be substantially non-absorbent, of and non-neutralizing of, ozone. These three sheets may be separate units or they may be components of a single member. Benwood et. al., U.S. Pat. No. 5,642,254 have described the use of a grounded bare metal electrode inserted into the floor of a Kodak Ektaprint 2100 primary charger. The present invention differs from this in that there is no exposed portion of a metal floor electrode in direct line of sight from a corona wire, nor is any portion of this electrode in contact with any inner surface of the shield facing the corona wires. A metal floor electrode is preferably completely surrounded by an insulating material, such as a polymeric material. Suitable provisions are made for grounding or otherwise electrically biasing the metal electrode, and for keeping an insert and any of its components in position within the insulating housing, e.g., by use of insulating polymeric screws such as PTFE screws, or by an adhesive. A commercially useful insert preferably comprises a monolithic member further comprising a smooth planar insulating element joined to a groundable preferably metal electrode having a planar surface in intimate contact with the planar insulating element, such that the planar plastic element faces the corona wires and completely covers the metal floor electrode so that no portion of the metal floor electrode is in direct line of sight from a corona wire nor is in electrical contact with any portion of that surface of the planar plastic element directly facing the corona wires. Joining methods may include lamination, adhesives, screws or pins or clips, and the like. A second planar insulating element may be joined to the side of the groundable electrode not facing the corona wires, or it may be inserted as a separate member between the groundable metal floor electrode and the shield. Alternatively, an insert may be made by enclosing, with insulating material, at least the surface of the groundable metal floor electrode that faces the corona wires, as well as the edges of this electrode and some portion of the face opposite the corona wires such that a connection to ground can be made. A monolithic unit may be attached to an existing plastic shield, such as a known shield forming a part of an Ektaprint EK 2100 primary charger, by any suitable method or means, such as for example by using press-fitting, an adhesive, screws or pins or clips, and the like. The shield may be modified, e.g., by drilling holes for screws for attaching a monolithic unit. An electrode of an insert may be made thick enough to provide extra rigidity of a shield. Alternatively, extra rigidity may be imparted by the thickness of the insulating portions of an insert. As is well known, an electrode provides electrical screening, which means that the composition of matter below the grounded surface of an electrode at the interface with a planar plastic element is immaterial, inasmuch as it has no influence on an electric field passing from the electrode surface through the insulating planar plastic element. Thus the metal floor electrode may have any suitable shape designed for strength and rigidity, providing it has a continuous planar interface with a planar plastic element situated between it and the corona wires. Thus the volume occupied by an electrode need not be solid and the electrode may have, for example, an inverted U-shape, or comprise a set of fins. One or more portions of an electrode of a monolithic unit, such as for example an arm of an inverted U-shape or a fin, may rest directly on the floor of a shield where it may be fastened to attach the unit to the shield, and may also be electrically grounded there, e.g., by direct contact with a grounded metal screw or pin passing though the floor. A planar plastic element of an insert that faces the corona wires preferably has a thickness in the range 0.05–10 mm, although thicknesses outside this range may also be used. Between the outer surface of a planar plastic element of an installed insert and the corona wires there is an air gap, preferably larger than 9 mm, although somewhat smaller air gaps may also be useful. An insert of the invention comprises a simple, inexpensive, and easy modification of an existing charger, not requiring retooling of a mold to make plastic shields.

More particularly it is preferable that the outer surface of the dielectric layer facing the corona wires (and covering the buried floor electrode) be spaced as close as possible to the corona wires without risk of arcing. Practically a spacing of about one centimeter is needed. It is preferable, therefore that a minimum separation between the outer surface of the dielectric layer and the corona wires be in the range 9 mm to 11 mm, although a separation outside of this range may also be usable. Equally preferably, the surface of the buried electrode facing the corona wires should be as close as practically possible to the corona wires, and therefore the dielectric layer is preferably as thin as possible without risking dielectric breakdown through it to the underlying buried electrode. A thickness of a typical dielectric layer comprising a high dielectric strength polymeric material is preferably in a range 0.002" to 0.006" (0.05–0.15 mm), although thicknesses outside of this range may be desirable depending upon the dielectric strength of the dielectric layer and the amplitude of the AC voltage signal applied to the corona wires. The spacing or separation between the corona wires and the buried electrode is preferably less than about 2.5 cm.

A modified application of the invention comprises using a longitudinal slot in a plastic shield, such that a motorized cleaning mechanism, comprising for example cleaning pads for cleaning corona wires and the inner surface of a grid, can be moved along the useful charging portions of the wires when a charger is not activated (and parked in known fashion at one end of a charger such that the useful charging portions of the wires are unobstructed during charging). Two monolithic inserts are put into a primary charger shield, such as, for example, used in a Kodak Ektaprint IS110 copier machine, such that each insert covers the floor of the charger on either side of the slot. Moreover, an insert also comprises a plastic covering of the edge of each metal electrode which abuts the slot, so that no part of a metal electrode has an exposed surface that could initiate a surface flashover discharge to a corona wire, thereby abruptly and prematurely ending a charger's anticipated life. Suitable provision is made for electrical grounding of each of the metal electrodes, either jointly or separately. When two inserts according to the invention are used to modify, for example, an Ektaprint IS110 charger, then the geometry of the supporting member for the cleaning pads (attached to a screw-drive mechanism below the slot) needs to be redesigned appropriately in order to fit into a smaller space between the corona wires and the top surfaces of the inserts. Apart from this, existing shields can be used without needing to retool the mold.

In yet another application of the invention, a charger shield comprising a buried groundable electrode is manufactured by potting an electrode element in an insulating polymeric material, e.g., inside a mold, and providing suitable means to make a ground connection to the electrode, preferably on a portion of its surface facing away from the corona wires. Alternatively a shield of the invention (not comprising a prior art shield) can be assembled from individual parts. Such a charger shield is functionally similar to the previously described apparatus, although the overall charger geometry may differ substantially from existing commercial chargers. A uniform dielectric coating or layer on the metal floor electrode surface facing the corona wires preferably has a thickness in the range 0.05–10 mm, although thicknesses outside this range may also be used. The resistivity of the dielectric coating or layer is preferably greater than $10^{10}$ Ωcm, and is more preferably greater than $10^{12}$ Ωcm. The dielectric constant of the dielectric coating is not critical, a range 3 to 10 being useful. Between the outer surface of the dielectric coating and the corona wires there is an air gap, preferably larger than 9 mm, although smaller air gaps may also be useful.

In applications of the invention described so far, reference has been made to planar charger elements. However, in an electrophotographic machine comprising a photoconductive drum, for example, a charger often has a curved rather than a planar configuration, in order better to fit the drum curvature. The invention can be adapted for charging curved surfaces, such as photoconductive drums, by providing a suitably curved, e.g., concentric grid, and a suitably curved, e.g., concentric, smooth surface (facing the corona wires) of a buried electrode covered or coated by a uniform layer of a highly insulating, high electrical breakdown strength, dielectric material such as, for example, a suitable polymeric material. The dielectric layer or coating preferably has a thickness in the range 0.05–10 mm, although thicknesses outside this range may also be used. The resistivity of the dielectric coating or layer is preferably greater than $10^{10}$ Ωcm, and is more preferably greater than $10^{12}$ Ωcm. Between the outer surface of the dielectric layer or coating and the corona wires there is an air gap, preferably larger than 9 mm, although somewhat smaller air gaps may also be useful. The outer facing surface of the dielectric layer is preferably also curved to be concentric with the photoconductive drum. Additionally, the corona wires are preferably arranged along a circle so as to be equally spaced from the drum.

A shield electrode of the invention is suitably conductive, and does not necessarily comprise metal.

A charger according to the invention may comprise a plastic shield having grounded electrodes buried in the sidewalls of the shield, preferably used in conjunction with a grounded electrode buried in the floor. Buried sidewall and floor electrodes may form a monolithic unit, such as a U-shaped member.

The present invention is thus distinguished from DelVecchio, U.S. Pat. No. 3,978,379, inasmuch as that prior art relates to a DC charger in which a conductive shield opposite the photoreceptor has a dielectric surface. According to DelVecchio, this dielectric surface increases the plate current component and decreases the shield current component, presumably because the dielectric surface charges to the same polarity as the corona wire and thereby tends to repel, toward the photoreceptor, a portion of the corona emission that would be otherwise directed towards the shield in the absence of the dielectric. In the present invention utilizing AC mode with both signs of corona being emitted from the corona wires, the detailed physics of what happens is much less clear. For example, we may assume that with AC corona the dielectric surface will become positively charged at the end of a positive half-cycle, and that when the polarity of the corona changes to negative in the next half-cycle, any such positive charge on the dielectric surface must be neutralized by negative corona charges before the dielectric surface can start to charge negatively. A similar phenomenon may be expected after the switch of polarity back to positive in the next half-cycle. It will be evident that a tendency of the charged dielectric surface to repel corona charges of the same polarity at the end of a half-cycle is counterbalanced by a tendency to attract corona charges at the beginning of the same half-cycle. It is well understood that the charging current to an uncharged photoconductor using a gridded AC corona wire charger has the same polarity as the grid, i.e., charging current is transmitted in a "pulsed DC" mode. Whether repulsion or attraction by a charged dielectric surface is the larger effect in any AC charging half-cycle will be determined by three main variables, namely, the relative magnitudes of the positive and negative corona currents emitted by the corona wires, the time constant for charging the capacitance associated with the dielectric, and the period of the AC corona excitation waveform. It is for these reasons that the present AC invention is not an obvious extension of the DC charger disclosed by DelVecchio.

The corona chargers of the present invention are also distinguished from Nishikawa et. al., U.S. Pat. No. 4,053,769, which discloses a DC charger comprising a shield covered with an "insulating layer" having a field-dependent "leak resistance". The chargers of the present invention feature an AC charger comprising a dielectric surface, on a conductive shield electrode, that is highly insulating for any degree of charging contemplated by the invention.

The corona chargers of the present invention are also distinguished from that of Reddy and Lipman in U.S. Pat. No. 5,568,230 who disclose a non-gridded AC charger having a conductive shell further comprising an ozone neutralizing element in the form of a liner of the shell. In view of the fact that the corona wire of Reddy and Lipman is coated with a highly insulating dielectric layer, the time-averaged corona current, i.e., the effective DC current, is necessarily equal to zero. The charger works by applying a DC voltage to the conductive shell, so that a charging current leaving the mouth of the charger is exactly balanced by a current of the opposite polarity going to the shell. It is obvious that in order for a charger described by Reddy and Lipman to operate continuously, a liner has to be conductive enough to pass this opposite polarity current to the conductive shell. Clearly, the present invention, which discloses corona wires uncoated by dielectric and a conductive shield covered by a nonconductive dielectric layer that is highly insulating for any contemplated AC current amplitude, is non-obvious with reference to U.S. Pat. No. 5,568,230.

Examples and modifications of the present invention are now described in more detail.

An end view sketch of a primary charger from Ektaprint 2100 electrophotographic machine, modified with inserted elements according to the present invention, is shown as 10 in FIG. 1. End flaps of the shield and other structure are not shown since they are conventional. Plastic shield 11, stainless steel grid electrode 12, and substantially bare corona wires 13 are shown disposed as in a standard Ektaprint 2100 charger. The corona wires are made of tungsten, stainless steel or any other suitable metal of high tensile strength and may be coated with for example a thin layer of gold or platinum and are not provided with a dielectric overcoat; i.e. they are substantially bare that is not having a dielectric coating. The corona wires 13 are spaced a suitable distance say about 1 cm from the grid electrode 12 and the grid electrode is spaced about 1.8 mm from the photoconductor PC and typically this spacing is from 1 mm to 2.5 mm. Photoconductor PC has a layer that is grounded. The photoconductor is to receive a uniform electrostatic charge from the corona charger 10. The photoconductor is moving in the process direction indicated by the arrow B which is perpendicular to the longitudinal direction of the shield which is supported so that the corona wires extend in a cross-track direction of the photoconductor. The floor of the charger referred to below is the original floor of the shield without insert. A 3-layer insert comprises a first insulating layer 14 of thickness $h_1$ consisting of one or more layers of 1/16 inch thick sheet PMMA, a 1/32 inch thick steel or metal (or other highly electrically conductive material) floor electrode 16, and below the electrode, a second insulating layer 15 of thickness $h_2$ made from (1/16) inch thick PMMA sheets. The height of the tops of the sidewalls 17*a*, 17*b* of the shield 11 above the floor 18 is 21/32 inch, and the vertical distance from the floor to a corona wire is 31/32 inch. The minimum value of $h_1$ is for this example, one sheet of PMMA if using 1/16" thick sheets. The minimum value of $h_2$ is zero. The electrode and PMMA sheets each have two holes through which nylon screws S1, S2 firmly attach the entire stack to threaded holes in the floor 18 of the shield 11. A portion of S1, S2 is indicated in FIG. 1. In addition, each PMMA sheet in the second insulating layer 15 is provided with a third hole so that a steel screw S3 engages a third threaded hole in the floor of the shield and passes through the third holes in the PMMA to press against the rear side of the electrode facing the floor. Metal floor electrode 16 may be grounded or otherwise electrically biased via contact with the head of the steel screw on the base of the charger. It is possible to bias the metal floor electrode with an AC bias having for example the same frequency as the bias to the corona charger, but DC bias such as ground is preferred and preferably the same bias as applied to the PC ground layer. The metal floor electrode should not be electrically floated by breaking its contact to ground. According to well-known electrostatic theory, when electrode 16 is floated, the dielectric behavior of the insert should be essentially the same as resulting from a total PMMA thickness ($h_1$+$h_2$). This is verified by experiment. A power supply 26 electrically biases the corona wires to an AC potential which may have a DC offset. A power supply 27 electrically biases the grid electrode 12 to a DC bias which represents the target level of charge to be imparted to the photoconductor. Where the screws are used as the means to hold the dielectric sheets in place the screws are spaced in the cross-track direction although the locations of screw positions are not critical.

Figure 2:
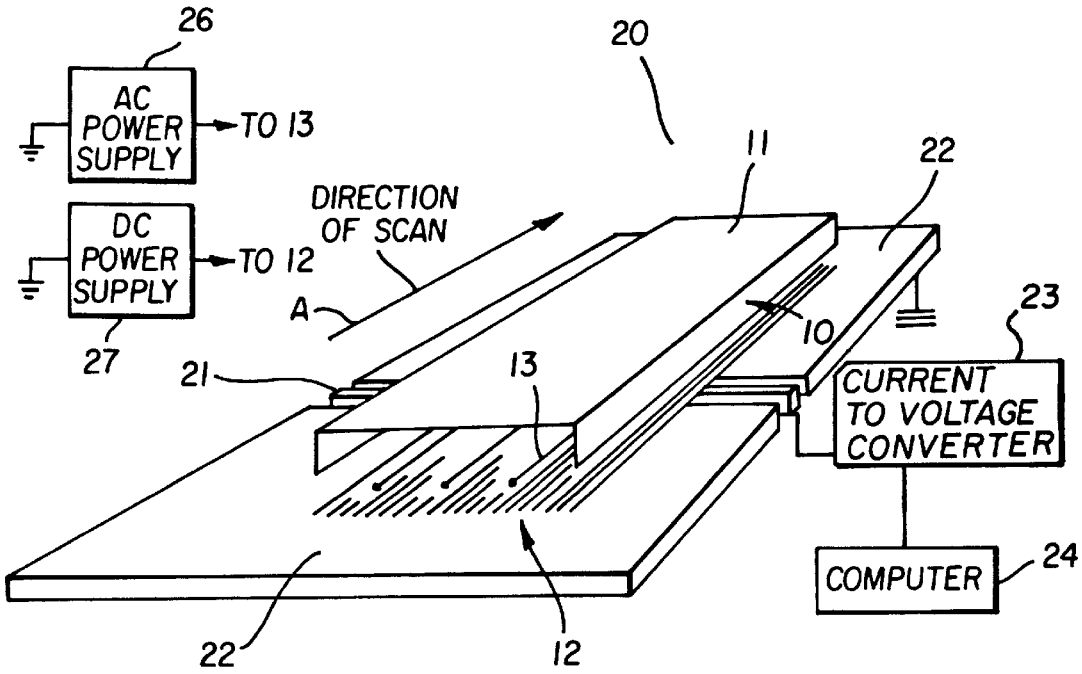
FIG. 2 is a schematic illustration of a perspective view of a corona charging apparatus of FIG. 1 but associated with a test scanning apparatus.

A scanning apparatus used to measure the uniformity of the charging current from corona charger 10 is shown as 20 in FIG. 2. A Trek 20/20 power supply 26 was used to activate or electrically bias the corona wires 13, and a Trek 677A power supply 27 was used to electrically bias the grid 12. The grid bias was −600 volts, the corona excitation was 14.0 kV peak to peak AC squarewave with a DC offset of −600 volts, and the nominal grid(12)-to-plate(22) spacing was 0.070 inch. Measurements of charging current uniformity were made by means of a translating probe electrode 21, 1 mm in width, held at ground potential. The electrode 21 was mounted in a narrow slit in a heavy, grounded plate 22 and the plate 22 and electrode 21 are mechanically moved relative to and along the length of the charger in the direction shown by arrow A. The scanner probe electrode 21 was of full charger width, allowing all three corona wires to be scanned simultaneously. A record of charging current as a function of position was obtained by collecting the probe current with a Stanford Research Systems current to voltage converter model SR570 (shown as 23), the output of which was sent to a computer 24. Digitized records of current scans were obtained, from which mean probe currents and standard deviations of these currents were computed. The standard deviation in the scanned probe current divided by the mean probe current for each scan is defined as a Noise/Signal Ratio, N/S. Each N/S value is a measure of charging current nonuniformity (crosstrack in an electrophotographic machine, i.e., perpendicular to the process direction) which may be expressed as a percentage charging current nonuniformity by multiplying N/S by 100. A charging current scan includes current fluctuations corresponding to relatively low spatial frequencies (wavelengths longer than about 1 cm) as well as higher frequencies (wavelengths between about 1 mm and 1 cm). The upper limit of measurable frequency is limited by the resolution of the scanner. The raw data of a charging current scan was filtered in the computer to produce a detrended signal from which wavelengths longer than about 1 cm had been removed. A detrended value of N/S was extracted from a detrended scan, and such detrended information does not include long wavelength current variations such as are caused, for example, by a lack of parallelism of the charger with the plate, by grid sag or other random geometrical variations. In order to judge relative charging efficiencies for different configurations of $h_1$ and $h_2$ as shown in FIG. 1, probe currents were averaged over the raw data of each scan (mean probe currents) and compared.

To measure whole charger charging currents employing the charger of FIG. 1, a large area metal plate electrode at ground potential was used to simulate charging an uncharged photoconductor. A Trek 10/10 power supply was used to activate the corona wires, and a Trek 610C supply was used to power the grid. Plate currents (corresponding to initial charging currents) were measured using a Keithley 237 Source Measure Unit for different configurations of $h_1$ and $h_2$ and the results are shown in Table 1. The grid bias was −600 volts, the corona excitation was 14.0 kV peak to peak AC squarewave with a DC offset of −600 volts, and the grid-to-plate spacing was 0.070 inch. Each configuration corresponding to FIG. 1 is represented by the following notation:

($h_1$, floor electrode condition, $h_2$)

where $h_1$ and $h_2$ are in units of sixteenths of an inch (each PMMA sheet was 1/16 inch thick). The floor electrode condition is shown as G=grounded, F=floating, 0=no floor electrode.

Inspection of Table 1 reveals that charging currents using an electrically floating floor electrode are not statistically different from charging currents measured with no floor electrode present for the same total thickness of PMMA, confirming expectations from electrostatic theory. Moreover, if the floor electrode is electrically floating or is absent, charging currents vary only weakly with the total thickness of PMMA, increasing slightly with increasing PMMA thickness. It is also clear that grounding the floor electrode causes a significant increase of charging current, and that this increase becomes larger as the height or spacing of the floor electrode above the charger floor is increased, i.e., the electrode is moved closer to the corona wires. In addition, any tested thickness greater than 1/16" of PMMA between the electrode and the corona wires has very little effect on the magnitude of the charging current. These observations are clearer from FIG. 4(*a*), in which the generalized symbols x or y represent corresponding numerals in the tested configurations given in Table 1.

TABLE 1

INITIAL CHARGING CURRENT

| Experiment | Configuration | Charging Current (minus μa) |
|---|---|---|
| 1-1 | [0,0,0] | 194 |
| 1-2 | [2,0,0] | 235 |
| 1-3 | [4,0,0] | 236 |
| 1-4 | [6,0,0] | 255 |
| 1-5 | [8,0,0] | 249 |
| 1-6 | [10,0,0] | 243 |
| 2-1 | [2,G,8] | 340 |
| 2-2 | [2,G,6] | 316 |
| 2-3 | [2,G,4] | 298 |
| 2-4 | [2,G,2] | 277 |
| 2-5 | [2,G,0] | 273 |
| 3-1 | [2,F,8] | 260 |
| 3-2 | [2,F,6] | 251 |
| 3-3 | [2,F,4] | 243 |
| 3-4 | [2,F,2] | 231 |
| 3-5 | [2,F,0] | 237 |
| 4-1 | [4,G,0] | 275 |
| 4-2 | [3,G,1] | 272 |
| 4-3 | [2,G,2] | 262 |
| 4-4 | [1,G,3] | 274 |
| 5-1 | [4,F,0] | 236 |
| 5-2 | [3,F,1] | 231 |
| 5-3 | [2,F,2] | 223 |
| 5-4 | [1,F,3] | 237 |
| 6-1 | [4,G,4] | 305 |
| 6-2 | [3,G,5] | 304 |
| 6-3 | [2,G,6] | 308 |
| 6-4 | [1,G,7] | 312 |
| 7-1 | [4,F,4] | 241 |
| 7-2 | [3,F,5] | 243 |
| 7-3 | [2,F,6] | 247 |
| 7-4 | [1,F,7] | 246 |

TABLE 2

SCANNING MEASUREMENTS

| Expt. | Configuration* | Mean Probe Current (minus na) | Standard Deviation [Raw] (na) | Standard Deviation [Detrended] (na) | % NU [Raw] | % NU [Detrended] |
|---|---|---|---|---|---|---|
| 8-1 | [0,0,0] 60 mil | 714.4 | 36.24 | 30.68 | 5.07 | 4.30 |
| 8-2 | [10,0,0] 60 mil | 728.2 | 37.73 | 28.93 | 5.18 | 3.97 |
| 8-3 | [2,G,8] 60 mil | 1066.9 | 24.58 | 15.70 | 2.30 | 1.47 |
| 8-4 | [2,F,8] 60 mil | 727.9 | 37.37 | 34.76 | 5.13 | 4.78 |
| 9-1 | [2,F,8] | 634.6 | 30.85 | 27.73 | 4.86 | 4.37 |
| 9-2 | [2,G,8] | 940.5 | 22.31 | 10.99 | 2.37 | 1.17 |
| 9-3 | [2,G,0] | 686.4 | 36.11 | 30.62 | 5.26 | 4.46 |
| 9-4 | [2,F,0] | 598.0 | 37.17 | 34.34 | 6.22 | 5.74 |
| 9-5 | [4,F,0] | 630.2 | 35.55 | 32.61 | 5.64 | 5.17 |
| 9-6 | [4,G,0] | 736.1 | 35.43 | 22.53 | 4.81 | 3.06 |
| 9-7 | [4,F,4] | 630.4 | 37.94 | 30.75 | 6.02 | 4.88 |
| 9-8 | [4,G,4] | 840.3 | 31.73 | 18.65 | 3.78 | 2.22 |
| 9-9 | [1,F,7] | 637.1 | 42.72 | 37.00 | 6.71 | 5.81 |
| 9-10 | [1,G,7] | 883.7 | 26.77 | 17.00 | 3.03 | 1.92 |

*Spacing = 70 mil, except 60 mil in experiment 8, as indicated in column 2.

Figure 4A:
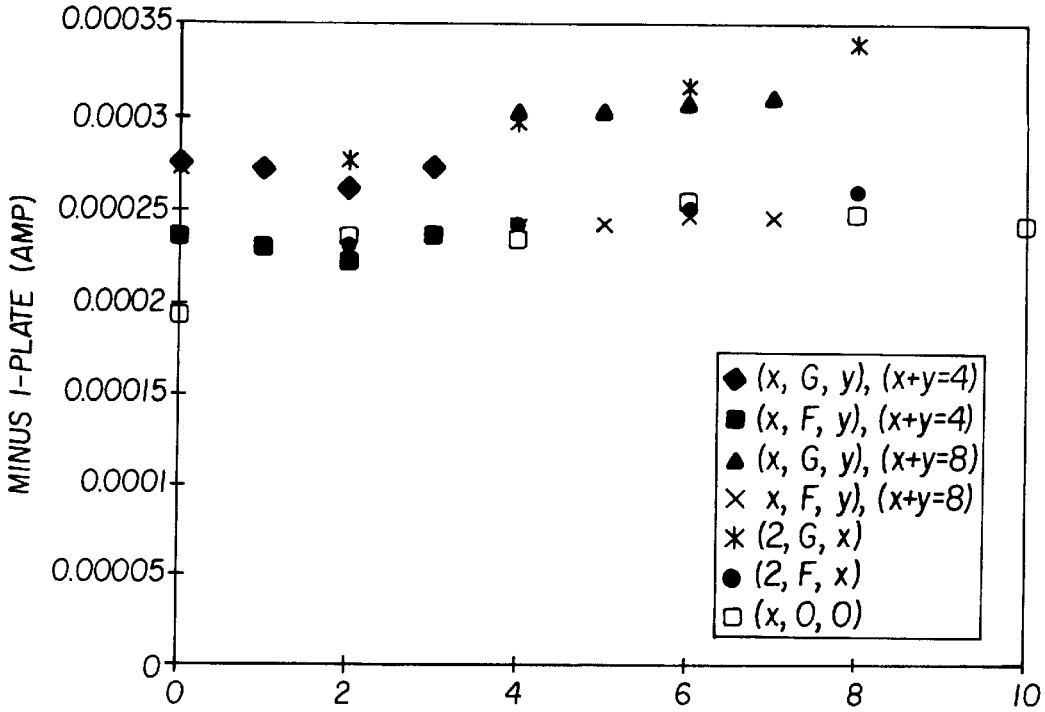
FIGS. 4(*a*), 4(*b*), and 4(*c*) are graphs of data relative to tests performed using a corona charger with a buried grounded (G) floor electrode, a floating (F) floor electrode and no (O) such electrode. The graphs plot component height of electrode above floor (if grounded electrode is used) with current detected at a grounded plate.
Figure 4B:
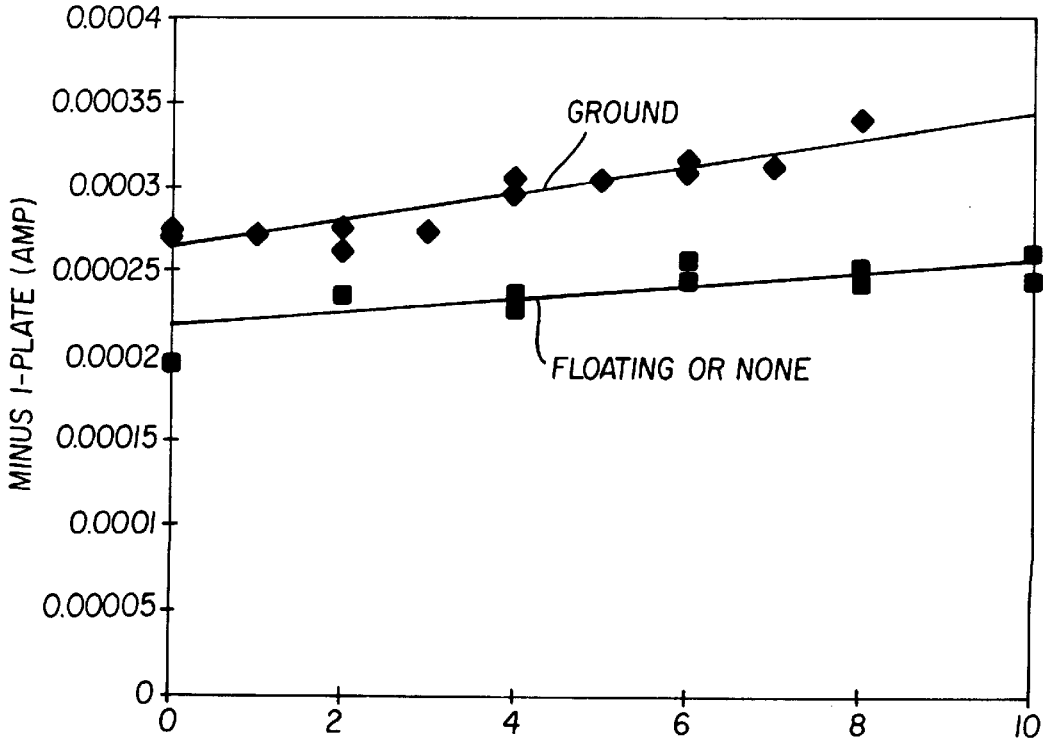
Figure 4C:
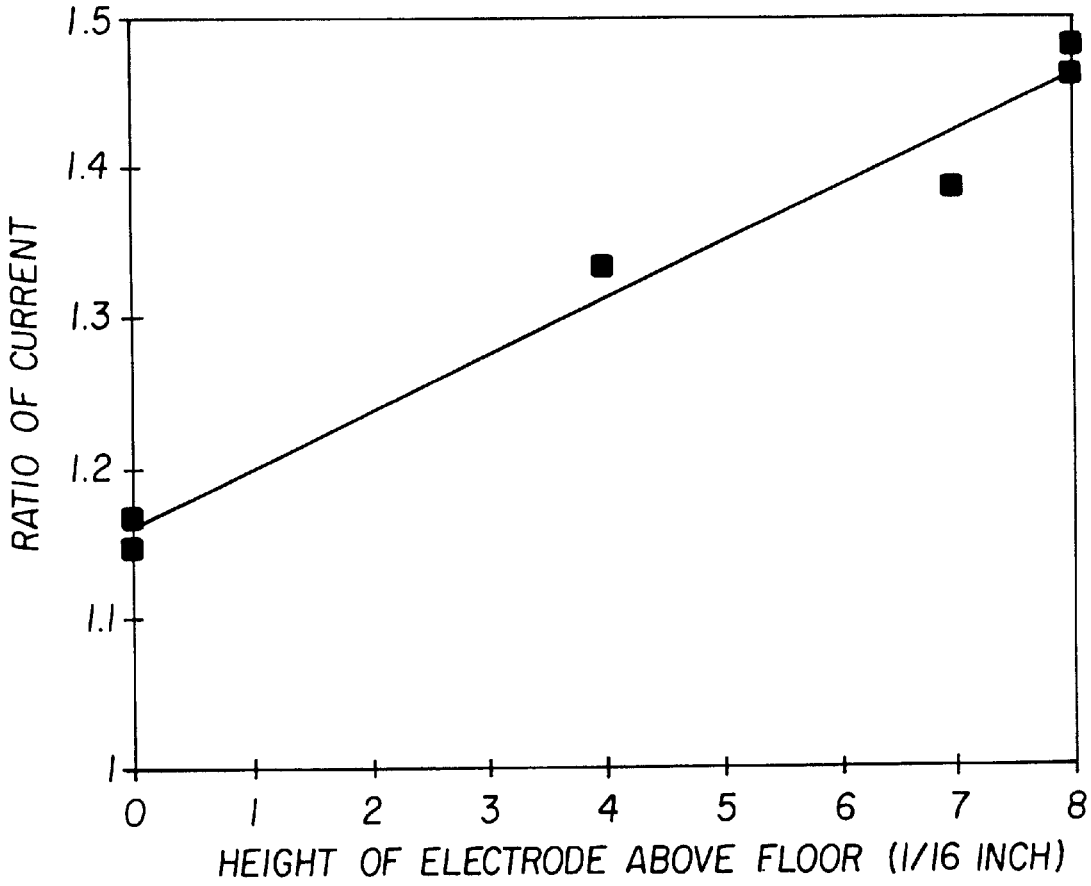

In view of the fact that the total thickness of PMMA is the relevant variable when the electrode is either electrically floating or absent, FIG. 4(*b*) has been plotted to more accurately show the effect of grounding the electrode. According to the data, locating a grounded floor electrode 10/16 inch (15.9 mm) above the charger floor increases charging current by 30.2% as compared to locating a grounded electrode on the floor (computed from the upper least squares fitted line), and increases charging current by 36.8% as compared to an unmodified charger.

It may similarly be concluded from ratios of mean probe current values listed in table 2 that using a grounded floor electrode provides considerable advantage in increasing the charging current. This can be seen by comparing experiment 8-3 with 8-4, 9-1 with 9-2, 9-3 with 9-4, 9-5 with 9-6, 9-7 with 9-8, and 9-9 with 9-10. A least squares fit line in FIG. 4(*c*) shows a ratio, of the probe current using a grounded electrode divided by the probe current using an electrically floating electrode, plotted as a function of the height of the grounded electrode above the charger floor. These probe data indicate a 32.3% increase in probe current by placing a grounded electrode 10/16 inch (15.9 mm) above the charger floor as compared to locating the grounded electrode on the charger floor, and agrees well with the value 30.2% derived above from FIG. 4(*b*). On the other hand, FIG. 4(*c*) predicts a 53.6% increase in probe current as compared to an unmodified charger, substantially higher than the 36.8% increase predicted from FIG. 4(*b*). The cause of this difference, while not understood, may be due to the different experimental setups for measuring current and powering the grid in the two sets of experiments. However, it is very clear that a substantially reduced charger impedance is obtained by practice of the present invention.

Figure 5A:
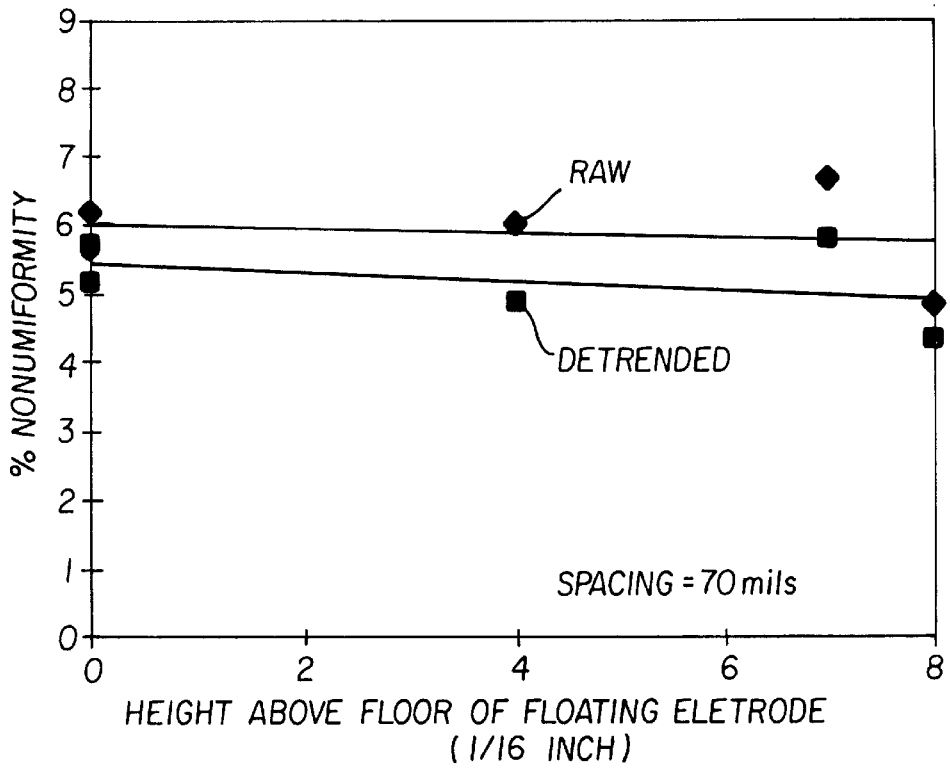
FIGS. 5(*a*) and 5(*b*) illustrate graphs of percent nonuniformity of charging current vs. height above floor of floating electrode or total thickness of insulation material in the case of the floating electrode.
Figure 5B:
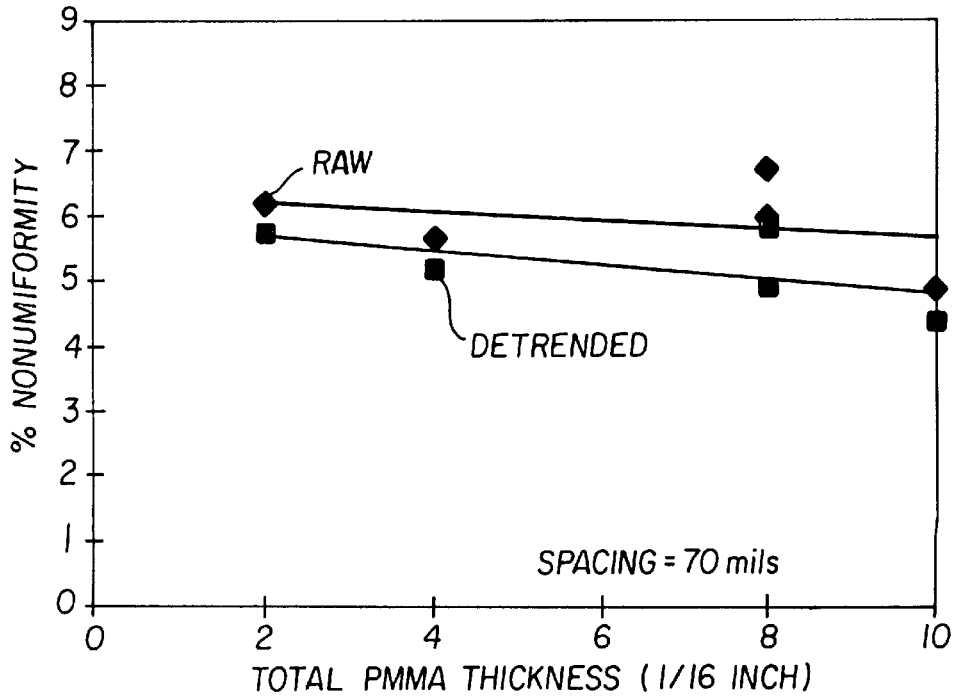

Turning now to charging current nonuniformity improvements obtained by the invention, the percent nonuniformity values shown in Table 2 demonstrate that use of a buried grounded electrode surprisingly reduces, by a large amount, fluctuations in the charging current along the length of a gridded corona charger. First we see the effect of using a floating electrode, or no electrode, as shown by FIGS. 5(*a*) and 5(*b*). FIG. 5(*a*) illustrates that the position of a floating electrode, whether or not covered with a layer of PMMA, is effectively immaterial in affecting charging current nonuniformity. FIG. 5(*b*) leads to a similar conclusion, showing a weak tendency towards reduction in nonuniformity as total thickness of PMMA is increased, regardless of the location of an electrically floating electrode. This slight improvement parallels the slight improvement in charging efficiency shown in FIG. 4(*b*) as total thickness of PMMA is increased.

Figure 6:
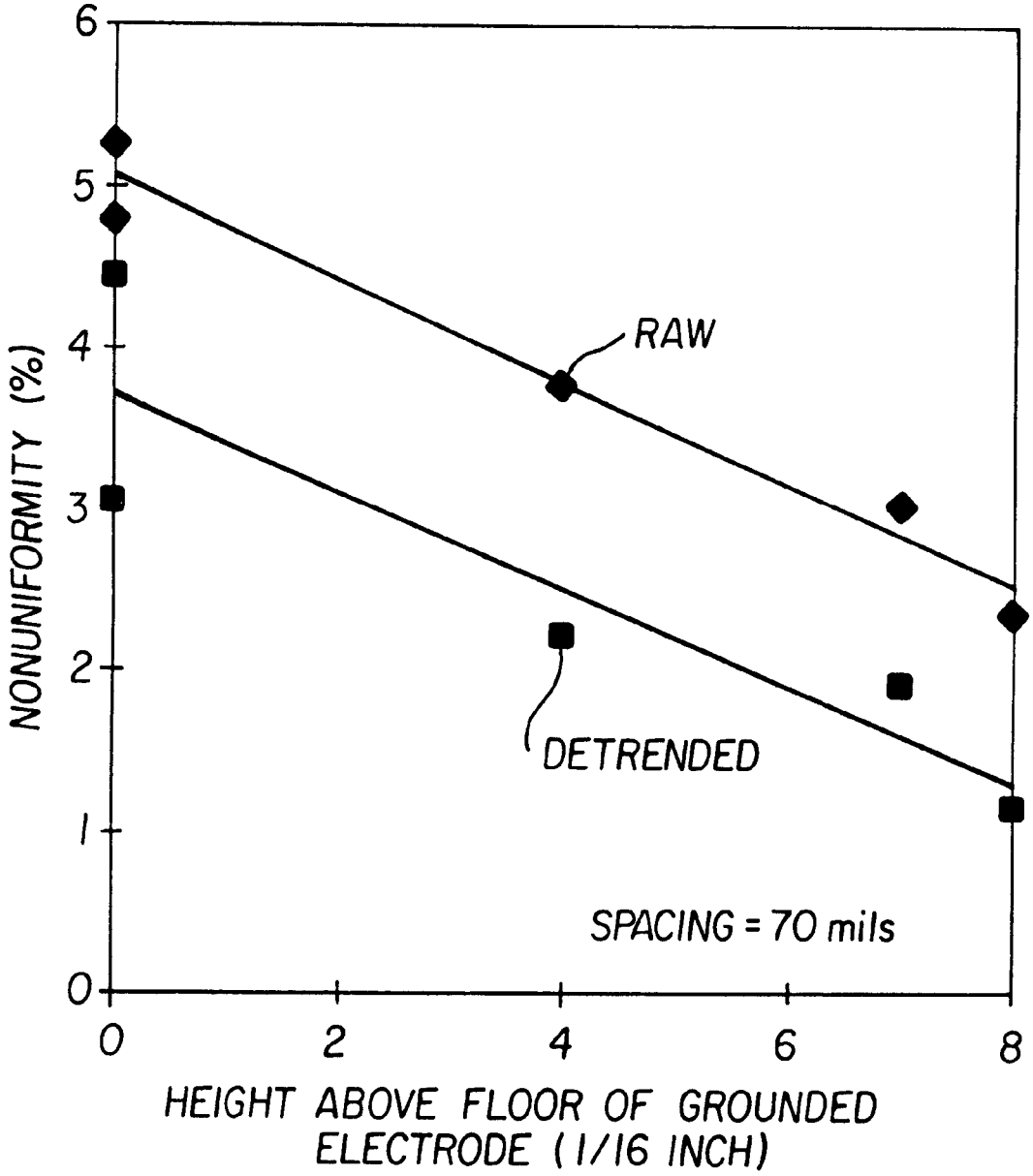
FIG. 6 is a graph of percent nonuniformity of charging current vs. height above floor of a grounded floor electrode.
Figure 7:
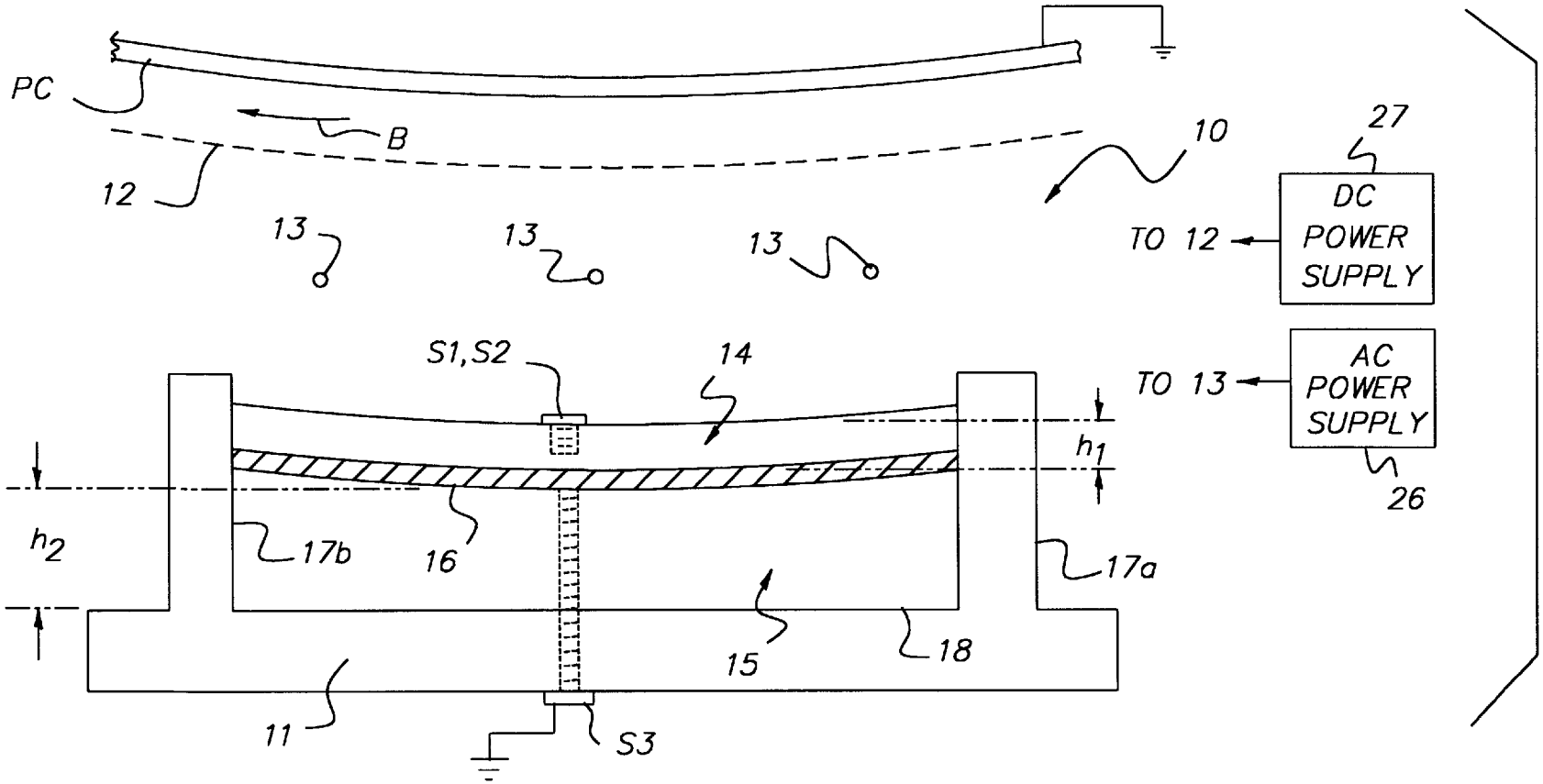
FIG. 7 is a view similar to that of FIG. 1 but illustrating an alternate embodiment of the invention for use with a curved photoconductive member.

In FIG. 6, percent nonuniformity is plotted as a function of the location of the grounded electrode, starting with the electrode on the floor. Both the nonuniformity derived from the raw scanning data and the detrended percent nonuniformity decline markedly as the grounded electrode is raised to 8/16" above the floor. The decline of the raw nonuniformity is approximately linear, as fitted by the upper least squares line, and the nonuniformity with the electrode 8/16" above the floor is calculated to be reduced to 50.1% of its value with the electrode on the floor. Similarly, the detrended nonuniformity with the electrode 8/16" above the floor is calculated to be reduced to 35.2% of its value with the electrode on the floor. Moreover, one can utilize the finding, from FIGS. 5(*a*) and 5(*b*), that added PMMA or a floating electrode has little effect on nonuniformity, to estimate values of raw and detrended percent nonuniformities for an unmodified charger. Averaging values from experiments 8-1, 9-4 and 9-5, we estimate (5.072+6.215+5.640)/3=5.642% for raw nonuniformity, and (4.295+5.742+5.174)=5.070% for detrended nonuniformity. From these estimates we infer that a grounded electrode placed 8/16 inch above the floor will reduce the raw nonuniformity by a factor [5.0462−(8)(0.3146)]/5.642=0.448, i.e., by 55.2%, and will reduce the detrended nonuniformity by a factor [3.7907−(8)(0.3007)]/5.070=0.273, i.e., by 72.7%. Simply using a PMMA-covered grounded floor electrode on the floor is estimated to reduce the raw nonuniformity by a factor 5.0462/5.642=0.894, i.e. by 10.6%, and the detrended nonuniformity by a factor 3.7097/5.070=0.732, i.e., by 26.8%.

Figure 3:
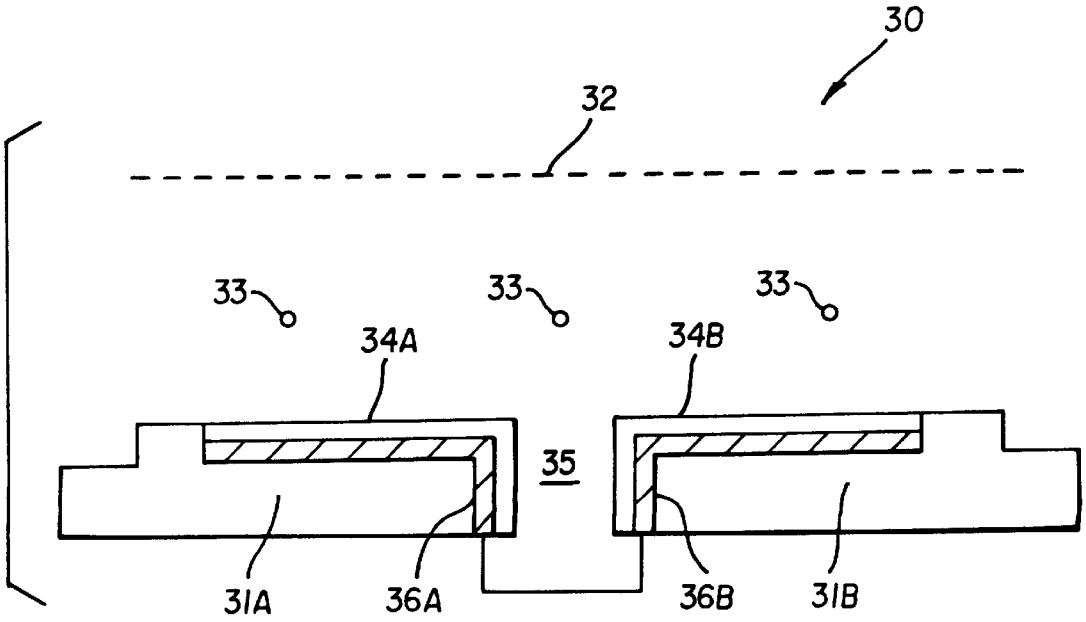
FIG. 3 is an end elevational view in schematic with certain details omitted and illustrating a second embodiment of a corona charging apparatus in accordance with the invention.

FIG. 3 shows an end elevational view in cross-section of an alternative embodiment of a charger 30 of the invention for which accommodation has been provided for a cleaner to clean the corona wires 33. Charger 30 comprises a slot 35 running the length of the charger shield housing floor along which a device comprising a cleaning pad (not shown) can be moved manually or by a motor drive along the length of the corona wires 33 and parked at one end of the charger under a portion of the corona wires 33 not utilized for corona. The cleaning pad is supported by a support (not shown) and, when activated, simultaneously rubs the upper surfaces of the wires 33 (closest to the grid 32) and the under surface of the grid 32 (closest to the wires 33). On either side of the slot is a portion of the charger comprising an insulating base member 31A or 31B, an L-shaped conductive floor electrode member 36A or 36B, and an insulating cover member 34A or 34B. Floor electrode members 36A and 36B preferably comprise a suitable metal or other similarly electrically conductive material. The floor electrode members 36*a* or 36*b* are completely shielded from direct line of sight of wires 33 by insulating cover members 34A and 34B. Floor electrode members 36A and 36B are connected to ground as shown, preferably by means making contact at the base of the charger as indicated in FIG. 3. The charger 30 as shown does not comprise sidewalls, but insulating sidewalls may be provided (not shown) which may additionally comprise grounded electrodes covered by insulating material. Such grounded electrodes in sidewalls may be extensions of the floor electrodes 36A and 36B. A dielectric cover member 34A or 34B preferably has a thickness in the range 0.05–10 mm, although thicknesses outside this range may also be used, and its resistivity is preferably greater than $10^{10}$ Ωcm, and more preferably greater than $10^{12}$ Ωcm.

An AC waveform for the corona wires is preferably produced by a square-wave excitation preferably with a negative DC offset, although other waveforms including sinusoidal waveforms may be used for excitation. A square wave excitation typically produces an approximately trapezoidal shaped output to the corona wires. A duty cycle of an AC square wave excitation for negative charging is defined as the percentage of the time the AC component of the square-wave excitation is in negative polarity during one AC cycle. A preferred range of duty cycle for negative charging is between 50% and 80% although duty cycles outside of this range may be useful. The most preferred duty cycle is 50%. A preferred DC offset is a DC voltage equal to that applied to the grid, typically minus 500 volts to minus 700 volts, though other DC offsets may be employed, including zero. A frequency of an AC waveform is preferably in a range 400 Hz to 1000 Hz, and more preferably 600 Hz, although other frequencies may be used.

The improved corona chargers of the invention thus provide an improved charging uniformity, and hence image quality, in a cost-effective and simple manner.

The invention has been described in detail with particular reference to certain preferred embodiments thereof, but it will be understood that variations and modifications can be effected within the spirit and scope of the invention.

What is claimed is:

1. A corona charger comprising:

an insulative shield;

an electrically biased grid electrode spaced from the shield;

one or more substantially bare corona wires located between the grid electrode and the shield, the one or more corona wires being electrically biased with an AC voltage;

an electrically biased highly conductive buried floor electrode having a surface located between the one or more corona wires and the shield; and an insulating layer between the one or more corona wires and the surface of the buried floor electrode that provides no exposure of the buried floor electrode in a direct line of sight from a corona wire, and wherein the insulating layer is at least 0.05 mm in thickness ($h_1$) and has a resistivity of greater than $10^{10}$ ohm-cm and has a surface that directly faces the one or more corona wires without presence of a conductive member between the insulating layer surface and the one or more corona wires.

2. The charger of claim 1 wherein the thickness $h_1$ is less than about 10 mm.

3. The charger of claim 1 wherein the AC voltage electrical bias has a duty cycle of between 50% and 80% and frequency of the AC waveform is in a range of about 400 Hz to about 1000 Hz.

4. The charger of claim 1 wherein the one or more corona wires comprise plural corona wires and a spacing of each of the plural corona wires from the insulating layer is between about 9 mm and about 25 mm.

5. The charger of claim 1 wherein the shield is of generally U-shaped configuration.

6. The charger of claim 1 wherein the grid electrode is electrically biased to a negative DC potential.

7. The charger of claim 1 wherein the insulating layer has a resistivity of $10^{12}$ ohm-cm or larger.

8. The charger of claim 6 wherein the insulating layer has a dielectric constant of between 3 and 10.

9. The charger of claim 7 wherein a spacing of the one or more corona wires from the insulating layer is between about 9 mm and about 25 mm.

10. The charger of claim 8 wherein the grid electrode is electrically biased to a negative DC potential.

11. The charger of claim 10 wherein the insulating layer is from at least 0.05 mm to about 10 mm in thickness.

12. The charger of claim 1 and including a slot formed within the shield in which a wire cleaner mechanism is free to move.

13. The charger of claim 1 wherein the insulating layer is substantially non-absorbent of and non-neutralizing of ozone.

14. The charger of claim 1 wherein the AC voltage electrical bias applied to the one or more corona wires has an approximately trapezoidal waveform shape and the electrically biased grid electrode is biased negatively.

15. The charger of claim 14 wherein the AC voltage electrical bias applied to the one or more corona wires has a DC offset bias whose polarity is the same as the bias on the grid electrode.

16. The charger of claim 15 wherein the grid electrode bias is negative.

17. The charger of claim 16 wherein the grid electrode bias is equal to the DC offset bias applied to the one or more corona wires.

18. The charger of claim 14 wherein the AC voltage electrical bias has a duty cycle of between 50% and 80% and frequency of the AC waveform is in a range of about 400 Hz to about 1000 Hz.

19. A method of charging a photoconductive member comprising;

operating the corona charger of claim 1 to deposit a uniform electrostatic charge on a surface of the photoconductive member as the photoconductive member is moved relative to the charger.

20. The method of claim 19 wherein the photoconductive member is curved and the charger has a plurality of said corona wires and the corona wires are spaced equally from the surface of the photoconductive member and the buried floor electrode is also curved.

21. The method of claim 19 wherein the photoconductive member includes a layer that is electrically grounded and the buried floor electrode is also grounded.

22. A corona charger comprising:

an insulative shield;

a grid electrode spaced from the shield;

one or more substantially bare corona wires located between the grid and the shield;

a highly conductive floor electrode having a surface located between the one or more corona wires and the shield;

an insulating layer between the one or more corona wires and the surface of the buried floor electrode that provides no exposure of the metal floor electrode in a direct line of sight from a corona wire, the insulating layer being from at least 0.05 mm to 10 mm in thickness and having a resistivity of greater than $10^{10}$ ohm-cm and the insulating layer has a surface directly facing the one or more corona wires without presence of a conductive member between the insulating layer surface and the one or more corona wires; and the corona wires being spaced from the floor electrode by a distance range of from about 9 mm to about 25 mm.

23. The corona charger of claim 22 wherein the charger includes plural of said bare corona wires, the wires being arranged along a curve and the floor electrode is curved.

24. A corona charger comprising:

an insulative shield;

one or more substantially bare corona wires located between the grid electrode and the shield, the one or more corona wires being electrically biased with an AC voltage that has a duty cycle of between 50% and 80% and frequency of the AC waveform is in a range of about 400 Hz to about 1000 Hz;

an electrically biased conductive buried floor electrode having a surface located between the one or more corona wires and the shield; and the shield having an insulating material between the one or more corona wires and the surface of the buried floor electrode that provides no exposure of the buried floor electrode in a direct line of sight from a corona wire, and wherein the insulating layer is at least 0.05 mm in thickness and has a resistivity of greater than $10^{10}$ ohm-cm and the insulating layer has a surface directly facing the one or more corona wires without presence of a conductive member between the insulating layer surface and the one or more corona wires.

25. The corona charger of claim 24 wherein the insulating material is exposed to the one or more corona wires and is substantially non-absorbent of and non-neutralizing of ozone.

* * * * *